United States Patent [19]

Levko

[11] Patent Number: 4,624,049

[45] Date of Patent: Nov. 25, 1986

[54] SWITCH ACTUATOR ASSEMBLY

[75] Inventor: Fred Levko, Evanston, Ill.

[73] Assignee: Illinois Tool Works Inc., Chicago, Ill.

[21] Appl. No.: 737,111

[22] Filed: May 23, 1985

[51] Int. Cl.[4] ..... H01H 11/06

[52] U.S. Cl. ..... 29/622; 29/418; 29/414; 200/284

[58] Field of Search ..... 29/622, 418, 412, 413, 29/414, 844, 876, 882; 200/275, 282, 283, 284

[56] References Cited

U.S. PATENT DOCUMENTS

| | | | |
|---|---|---|---|
| 3,643,051 | 2/1972 | Foley | 200/275 |
| 4,253,232 | 3/1981 | Bennett et al. | 29/418 |
| 4,371,759 | 2/1983 | Clark, Jr. | 200/159 A |
| 4,380,858 | 4/1983 | Gudbrandsen | 29/418 |
| 4,464,550 | 8/1984 | Soes | 200/283 |
| 4,490,903 | 1/1985 | Agatahama | 29/622 |

FOREIGN PATENT DOCUMENTS

| | | | |
|---|---|---|---|
| 684123 | 12/1952 | United Kingdom | 29/882 |
| 1442196 | 7/1976 | United Kingdom | 29/622 |

*Primary Examiner*—Howard N. Goldberg
*Assistant Examiner*—P. W. Echols
*Attorney, Agent, or Firm*—Donald D. Mondul; T. W. Buckman

[57] ABSTRACT

A switch actuator assembly comprises an insulating base and an insulating retainer assembled therewith. A switch contact assembly initially includes at least a first contact and a second contact interconnected by an integral narrow strip of sheet metal. The base and retainer are provided with an integral punch and die, and during assembly of the switch contact assembly with the base and the retainer the punch and die sever the connecting strip so that the first and second contacts are thereafter electrically isolated. During such severing the strip is deflected from its initial plane to augment the electrical isolation.

4 Claims, 13 Drawing Figures

SWITCH ACTUATOR ASSEMBLY

BACKGROUND OF THE INVENTION

In certain switch applications it is often desirable to operate two electrically operated sets of switch contacts as an incident to operation of a single switch actuator. For example, this may occur in automotive switches involving lighting, or involving windshield wiper operation and washer actuation, etc. In automotive use it is common for the demand for a switch to run as high as several hundred thousand or even into the millions per year. Economies in the use of materials and in fabrication labor time therefore are critical.

OBJECTS AND SUMMARY OF THE PRESENT INVENTION

It is an object of the present invention to provide a switch actuator assembly wherein two electrically isolated sets of switch contacts are operated by a single actuator wherein all of the contacts are mechanically and electrically integral prior to assembly with the switch actuator More particularly, it is an object of the present invention to provide a switch actuator assembly in which an integral mechanical and electrical connection between switch contacts is severed and moved out of possible engagement during assembly of the switch contacts with the switch actuator.

An insulating plastic base member comprises a slider and has an actuating arm extending therefrom. A switch contact assembly in the form of an inverted U is laid over the base member. The base member has an upstanding portion which comprises a punch or hammer and the switch assembly is made of a suitable electrically conductive resilient metal and includes two sets of switch contacts which are initially interconnected by two very thin integral metal strips. These strips lie across the punch or hammer. A plastic retainer is inserted over the switch contacts and over the base, and includes a cavity serving as a die or anvil which interfits with the upstanding punch, whereby assembly of the overlying portion with the base severs the interconnecting strips to leave the two sets of switch contacts electrically isolated from one another. The scrap formed from the two initial interconncting strips remains as a part of the switch assembly, but these scrap portions are isolated from one another by the plastic punch, whereby the two sets of switch contacts are ever after electrically isolated.

THE DRAWINGS

The present invention will best be understood with reference to the following specification when taken in connection with the accompanying drawings wherein:

FIG. 1 comprises a side view of a switch actuator assembly constructed in accordance with the principles of the present invention;

DETAILED DISCLOSURE OF THE ILLUSTRATED EMBODIMENT

Turning now in greater particularity to the drawings, and first to FIGS. 1–4, there will be seen a switch actuator assembly 20. The switch actuator assembly comprises an insulating base 22 molded of a suitable plastic material, a conductive switch contact assembly or contactor 24 stamped of a suitable conductive sheet material such as copper or brass and which lies over the base 22, and a cap or retainer 26 which fits over the contactor 24 and snaps together with the base 22 to form the switch actuator assembly 20.

Figure 1:
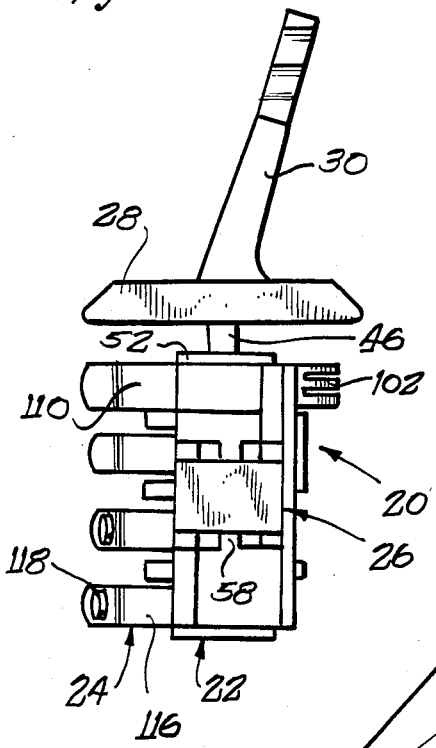
Figure 2:
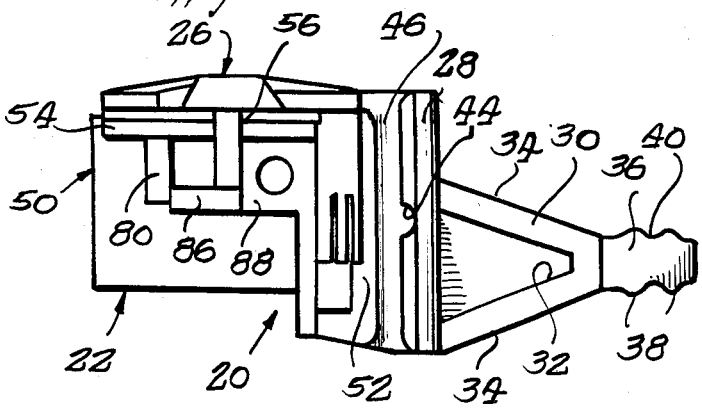
FIG. 2 is a view of the same switch actuator assembly taken from the right side of FIG. 1, the view being rotated 90 degrees.
Figure 4:
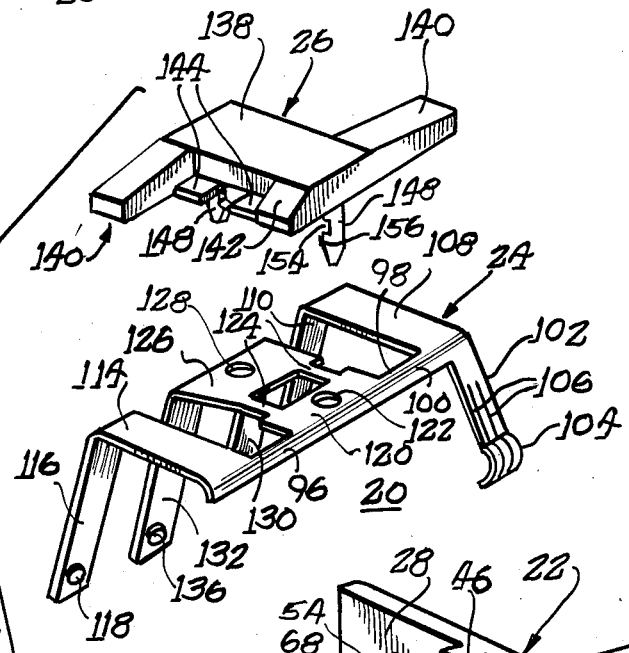
FIG. 4 is an exploded perspective view of the parts of the present invention prior to assembly.
Figure 3:
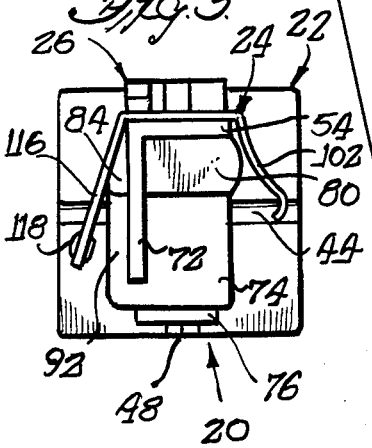
FIG. 3 is an end view similar to FIGS. 1 and 2 showing only the base and the electrical switch contacts prior to assembly of the cap or retainer therewith.
Figure 3:
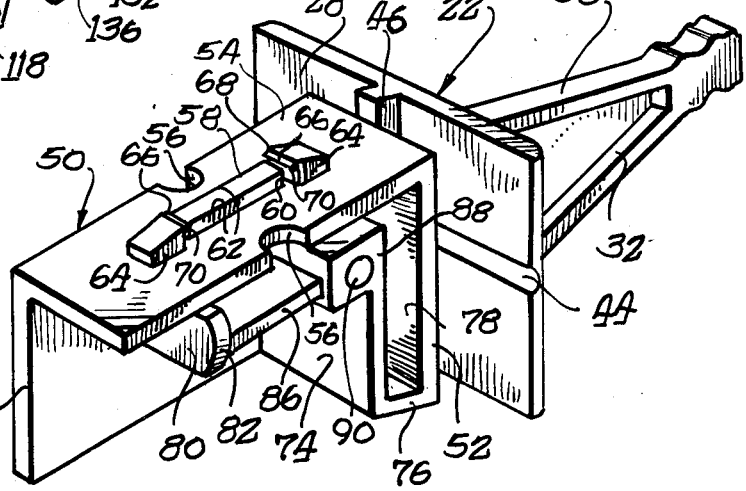

The switch actuator assembly may be installed in any position. However, for sake of reference it will be assumed that the position shown in FIGS. 2–4 is the upright position. The base 22 includes a transverse vertical plate 28 having on its outer face an outwardly angled arm 30 recessed on one face at 32 and tapering on two edges at 34 to an outer connector end 36 having outward protuberances 38 and an intervening recess 40 for receipt of an ornamental, manually engageable operator for moving the switch actuator assembly. The plate on its inner face is provided with a transverse recess 44 which is of no particular importance to the invention as herein shown and described.

A vertical wall 46 extends inwardly from the inner face of the wall or plate 28 and has integrally formed therewith a body 50 including an end wall 52 and a horizontal rectangular top plate 54. Intermediate its ends the top plate 54 is provided with edge opening recesses 56 which are slightly greater than semi-circles.

A small wall or rib 58 upstands from the top plate 54 along the center line thereof, and equally spaced from end-to-end. The rib has ends 60, only one of which shows in FIG. 4, and the rib has right-angle upper longitudinal edges or shoulders 62. Upstanding posts 64 are spaced from the ends 60 and have teeth 66 projecting toward the rib 58. The teeth taper down toward the rib, forming cam surfaces 68 on the upper sides thereof. The teeth have underlying retention shoulders 70. The underlying retention shoulders are substantially on a level with the top surface of the rib 58.

A vertical wall 72 meets with a transverse wall 74 spaced a short distance from the wall 52 and connected thereto at the top by the plate 54, and at the bottom by an inclined wall 76. This provides a cavity 78 between the walls 52 and 74.

A short transverse vertical wall 80 extends to the right from the wall 72 and integral with the top plate 54. The wall 80 extends slightly past the edge of the top plate, and is provided with a rounded outer end 82. A wall 84 coplanar with the wall 80 extends to the left of the wall 72 and likewise is provided with a somewhat rounded outer end. The walls 80 and 84 are of shallow height relative to the wall 74. A floor 86 extends from the wall 80, slightly short of the outer end thereof, toward the wall 74 to which it is joined by a square boss 88 having a cylindrical bore 90 therein. This bore is designed to receive a spring and ball for detenting the switch actuator assembly as it is slideably moved back and forth.

The wall 74 has a narrow portion 92 extending to the left of the wall 72 the same distance as the wall 84. The leftmost recess 56 extends vertically down to the floor 86 as shown at 94 in FIGS. 9–11. All of the parts of the base as heretofore shown and described will be understood as comprising a single integral plastic molding.

Figure 5:
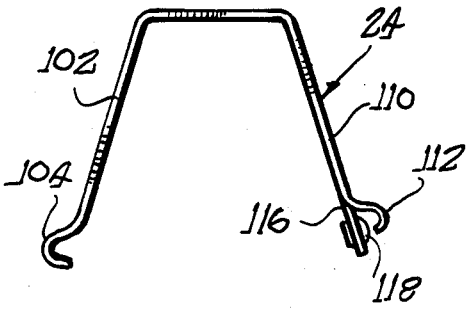
FIG. 5 is an end view of the switch contact assembly on an enlarged scale.
Figure 7:
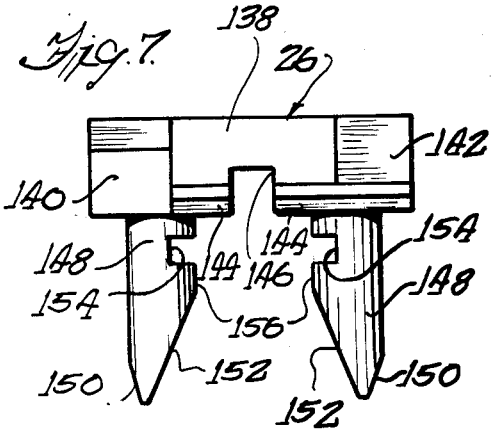
FIG. 7 is a side view of the cap.
Figure 6:
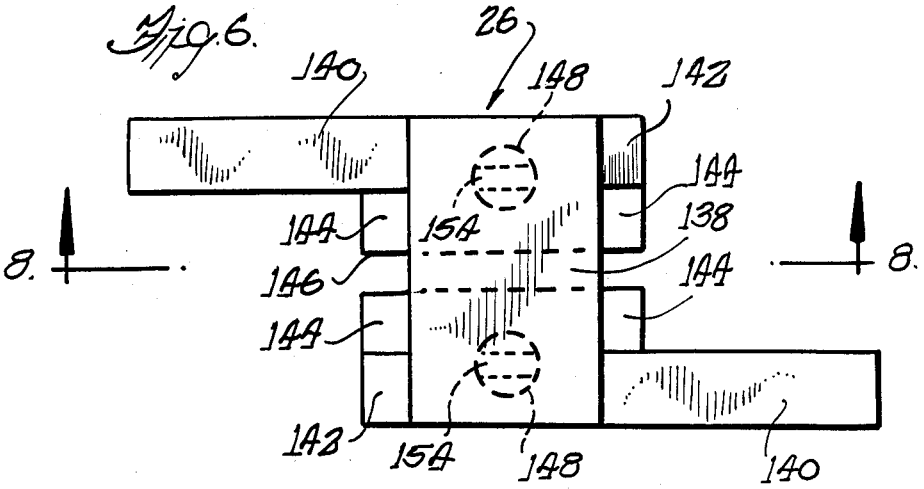
FIG. 6 is a top view on an enlarged scale of the cap.
Figure 8:
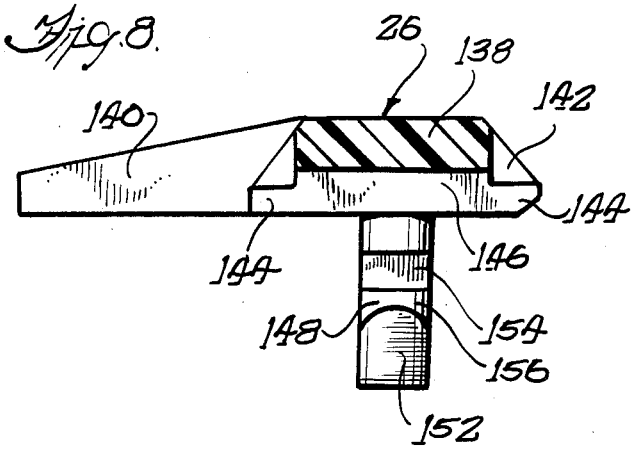
FIG. 8 is a cross-sectional view as taken substantially along the line 8—8 in FIG. 6.
Figure 12:
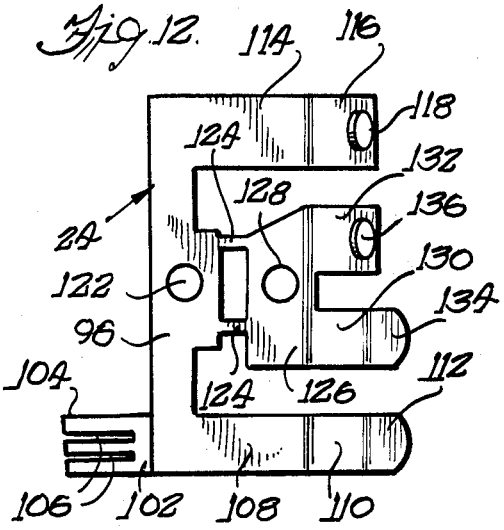
FIG. 12 is a bottom view of the electrical contact assembly before assembling essentially on the same scale as FIG. 4.

The switch contact assembly or connector 24 prior to assembly with the base and the cap is best seen in FIGS. 4, 5 and 12. The connector is reversed in FIGS. 5 and 12 relative to FIG. 4. The connector is of generally inverted U-shape and comprises an elongated runner 96 having a horizontal flange 98 lying on the bight of the U, and a depending angled flange 100 lying on one leg of the U. At the far end of the runner 96 as viewed in FIG. 4 there is a depending contactor leg 102 having a rounded lower end 104 for effecting contact with a fixed switch contact. The leg 102 including the rounded contact portion 104 is provided with a pair of longitudinal slits 106 providing enhanced flexibility to the leg, and hence better contact engagement. In substantial alignment with the leg 102 there is provided a transverse strap portion 108 lying in the bight of the U, and having at its opposite end a downwardly and outwardly extending contact leg 110. This leg is also provided with an outwardly rounded lower end 112 for engagement with a fixed contact. No longitudinal slits are provided in this leg.

At the opposite end of the runner 96 there is a transverse strap portion 114 which is coplanar with the strap portion 108 and has at its opposite end a downwardly and outwardly angled leg 116 having a contact 118 of silver or other suitable contacting metal riveted thereon.

Intermediate the ends of the runner 96 and coplanar with the strap portions 108 and 114 there is an integral, elongated flange 120 having a circular aperture 122 in the center thereof. Relatively adjacent the ends of the flange 120 there are two narrow strips 124 integrally connecting a coplanar flange 126 with the flange 120. A circular aperture 128 is provided adjacent the center of the flange 126. A pair of spaced legs 130 and 132 angle downwardly from the far edge of the flange 126 in coplanar relationship with the legs 110 and 116. The leg 130 adjacent its lower end is provided with an outwardly rounded contacting portion 134, while the leg 132 is provided near its lower end with a riveted contact 136. The narrow connecting strips 124 are of particular importance as will be brought out hereinafter.

The cap 26 is best seen in FIGS. 4 and 6–8 and comprises a top horizontal, substantially flat head 138 having opposite lateral edges from each of which an arm 140 extends longitudinally, the two arms extending in opposite directions, and from opposite longitudinal edges. Tapered stub flanges 142 respectively extend oppositely of the arms 140 from the head 138. Narrow walls 144 underlie the head 138 surfaces of the arms 140 and flanges 142. The walls 144 extend longitudinally in either direction beyond the head 138, and are spaced apart along the longitudinal center line providing a channel 146 therebetween.

A pair of cylindrical pins 148 depends from the head 138 and walls 144 and are spaced outwardly of the channel 146. The pins are provided near their lower ends with relatively short bevels 150 on the outer portions, and with relatively longer bevels 152 on the inner portions. Notches 154 lie on the inner aspects of the pins in confronting relation, spaced a predetermined distance down from the bottoms of the walls 144 and are of a predetermined height. Each notch 154 and bevel 152 defines a latching tooth.

Figure 9:
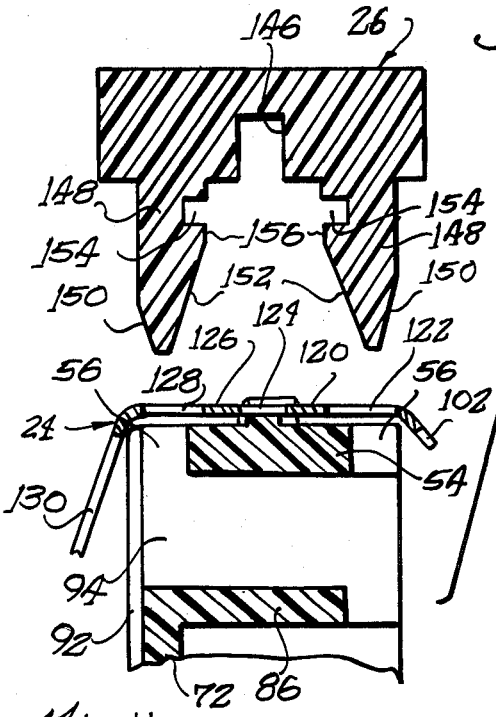
FIG. 9 is an end view of the parts of the switch actuator assembly at the start of an assembling operation, the view being on an enlarged scale and parts being broken away for clarity of illustration.
Figure 10:
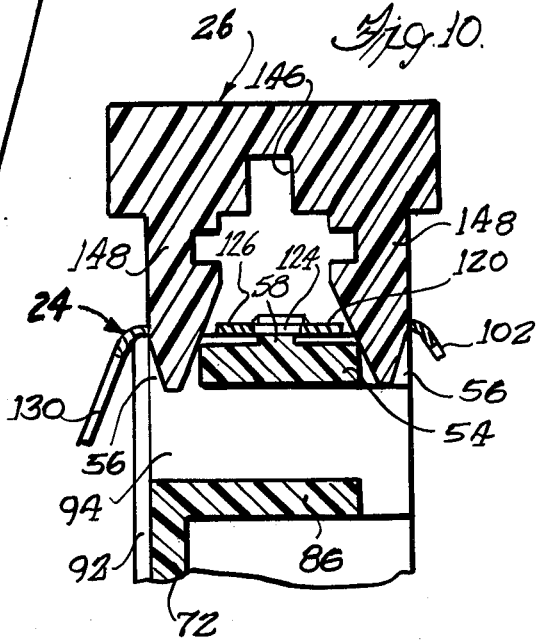
FIG. 10 is a view similar to FIG. 9 with the assembling operation having been partially completed.
Figure 11:
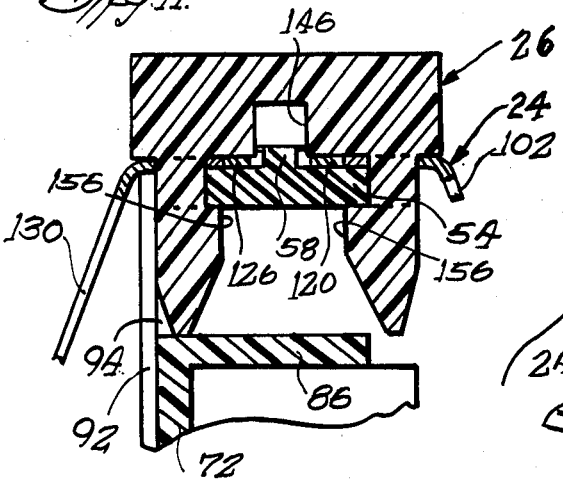
FIG. 11 is a view similar to FIGS. 9 and 10 with the assembling operation completed.

Assembly of the parts will best be understood with reference to FIGS. 9–11. The connector 24 is laid across the top of the base 22, and particularly the narrow connecting strips 124 lie across the tops of the rib 58. The cap 26 is positioned above the base and the connector as in FIG. 9, and is then lowered as in FIG. 10 with the pins passing through the holes 122 and 128 and down into the recesses 56, the parts being centered by the tapered lower portions 150 and 152 of the pins. Finally, as the cap is moved into the position shown in FIG. 11 the rib 58 acts as a punch and the channel 146 as a die to fracture the narrow connecting strips 124 and to bend them up at 157 where they are electrically isolated from one another along the opposite sides of the rib 58. At the same time the notches 154 in the pins receive opposite edges of the wall 54 to anchor the cap. This is augmented by the walls 144 snapping over the teeth 66 and beneath the undersurfaces 70 thereof. The cap thus is unreleasably held to the base and holds the connector in place.

Figure 13:
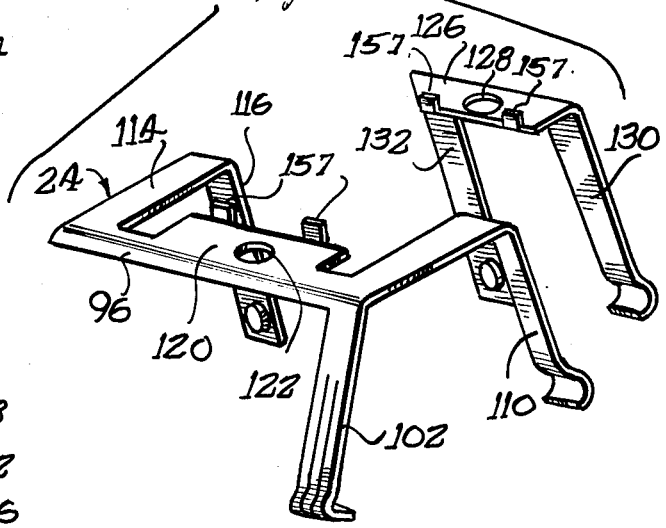
FIG. 13 is an exploded perspective view of the electrical switch contact assembly on an intermediate scale after the completion of the assembling operation.

FIG. 13 illustrates the connector 24 as it would appear after assembly if it were removed from the base and the cap. It will be seen that the turned up tabs 157 remain connected with the respective flanges 120 and 126. In effect the strips and turned up tabs comprise scrap that is left integral with the final switch actuator assembly. It will be seen that the switch arms 130 and 132 now are electrically isolated from the remaining switch arms 102, 110 and 116 without the necessity of handling of two separate parts during assembly.

The specific example of the invention as herein shown and described will be understood as being for illustrative purposes only. Various changes in structure will no doubt occur to those skilled in the art, and will be understood as forming a part of the present invention insofar as they fall within the spirit and scope of the appended claims.

The invention is claimed as follows:

1. The method of producing a switch actuator assembly which comprises providing an insulating base having first severing means thereon, assembling a sheet metal switch contact assembly with said base, said switch contact assembly having electrically conductive first and second switch contact means integrally interconnected by a severable area, positioning said switch contact assembly with said severable area adjacent said first severing means, and assembling insulating retainer means with said base and said switch contact assembly, said retainer means including second severing means, and during assembly of said retainer means with said base and said switch contact assembly utilizing said first and second severing means to sever said severable area electrically to isolate said first and said second switch contact means from one another.

2. The method as set forth in claim 1 and further including positioning at least one of said first and second severing means between the severed portions of said severable area for electrical isolation of said first and said second switch contact means.

3. The method as set forth in claim 2 and further including deflecting a severed area as an incident to severing thereof.

4. The method as set forth in claim 1 and further including deflecting a severed area as an incident to severing thereof.

* * * * *